United States Patent [19]

Boult et al.

[11] Patent Number: 4,503,866

[45] Date of Patent: Mar. 12, 1985

[54] CIGARETTE OR FILTER ROD CUT-OFF DEVICE

[75] Inventors: George W. Boult; Richard R. King, both of High Wycombe, England

[73] Assignee: Molins PLC, London, England

[21] Appl. No.: 371,573

[22] Filed: Apr. 26, 1982

[30] Foreign Application Priority Data

Apr. 28, 1981 [GB] United Kingdom ..... 8113092

[51] Int. Cl.[3] ..... A24C 5/28

[52] U.S. Cl. ..... 131/84 C; 131/83 R; 83/174.1

[58] Field of Search ..... 131/280, 28, 83 R, 84 R, 131/84 C; 83/174, 174.1

[56] References Cited

U.S. PATENT DOCUMENTS

| | | | |
|---|---|---|---|
| 4,210,159 | 7/1980 | Quarenghi | 131/84 C |
| 4,276,891 | 7/1981 | Dyett et al. | 131/84 C |
| 4,304,243 | 12/1981 | Seragnoli | 131/84 C |

*Primary Examiner*—Vincent Millin

*Attorney, Agent, or Firm*—Antonelli, Terry & Wands

[57] ABSTRACT

A cut-off device for a cigarette or filter rod making machine is designed to work with a knife having an aperture which, when the knife is spent, is detected by a system including a light emitter and a detector, with an electronic timing system sensitive to specific light-/dark transitions to enable the presence of an aperture to be detected at various speeds of rotation of the member carrying the knife.

5 Claims, 9 Drawing Figures

A
B
C
D
E
F
G
H
I
J
K

CIGARETTE OR FILTER ROD CUT-OFF DEVICE

This invention is concerned with cut-off devices for use in a machine for making cigarettes or similar rods (e.g. filters) by cutting a continuous rod at regular intervals. For convenience the invention will be described in terms of a cut-off device for a cigarette making machine, but it should be understood that the device may be used for cutting other similar rods of the cigarette industry, especially filters.

A cut-off device for a cigarette making machine commonly includes a knife which is carried by a rotary member so as to cut the cigarette rod during each revolution. During each revolution (or possibly less frequently) the knife is sharpened by a grinding device; and to compensate for the loss of material caused by sharpening, the knife is slowly fed radially outwards, either continuously or stepwise. Eventually, when the knife can be fed no further (i.e. is spent) it must be replaced. The present invention is concerned with a system for indicating when the knife is spent.

According to this invention, a cut-off device for a cigarette making machine comprises a rotary member arranged to carry at least one knife for cutting a cigarette rod during each revolution of the rotary member, means for sharpening the cutting edge of the knife (either during each revolution or possibly less frequently), and means for slowly feeding the knife radially outwards to compensate for the removal of material by the sharpening means, wherein the cut-off device is arranged to be used with a knife formed with an aperture which will appear outside the rotary member when the knife is ready to be replaced, and includes means for detecting the aperture, the detecting means comprising a light emitter mounted on one side of the path of the knife, a light detector mounted on the other side of the path of the knife so as to receive a beam of light from the light emitter when the beam is not being interrupted by the knife, timing means responsive to the light detector detecting a predetermined light/dark transition, for defining a predetermined time interval, and means responsive for the duration of said time interval to a subsequent predetermined light/dark transition for providing an indication that the hole has been detected.

According to a preferred embodiment of the invention each of the predetermined light/dark transitions is a light-to-dark transition, and the predetermined interval endures at least until the trailing edge of the knife passes the detector but not until the leading edge of the next knife (or the same knife in the case of a single rotating knife) passes the detector. Thus the timing means is operated by a light-to-dark transition caused by the leading edge of the knife interrupting the beam; and a warning signal is produced when a second light-to-dark transition occurs at the termination of a short pulse of light through the aperture in a spent knife. As the predetermined time interval in this preferred embodiment is of a duration such as to include the dark-to-light transition (to which the circuit of the preferred embodiment will not respond) produced when the trailing edge of the knife passes the beam, this arrangement is less affected by the speed of rotation of the knife, which speed may in practice vary considerably. The only criterion in the preferred embodiment for the length of the predetermined time interval is that it should end before the beam of light is again interrupted either by the same knife (in the case of a single-knife cut-off) or by the next knife in the case of a multiple-knife cut-off; that is to say, when the cut-off device is rotating at its maximum speed.

Retriggerable timing means may be actuated by an indication that the aperture has been detected so as to provide a substantially continuous warning signal when the hole is detected. The output of the retriggerable timing means may be sampled periodically, for example by a microprocessor which responds to a predetermined number of consecutively sampled outputs to produce a warning signal and to stop the machine so that the knife can be replaced.

It will be appreciated that the term "light" used herein is not limited to visible light but is intended to include non-visible light and also electromagnetic radiation. The preferred embodiment employs non-visible infra-red light e.g. with a spectral emission of 940 nanometers peak.

An example of apparatus according to this invention is shown in the accompanying drawings, in which.

Figure 3:
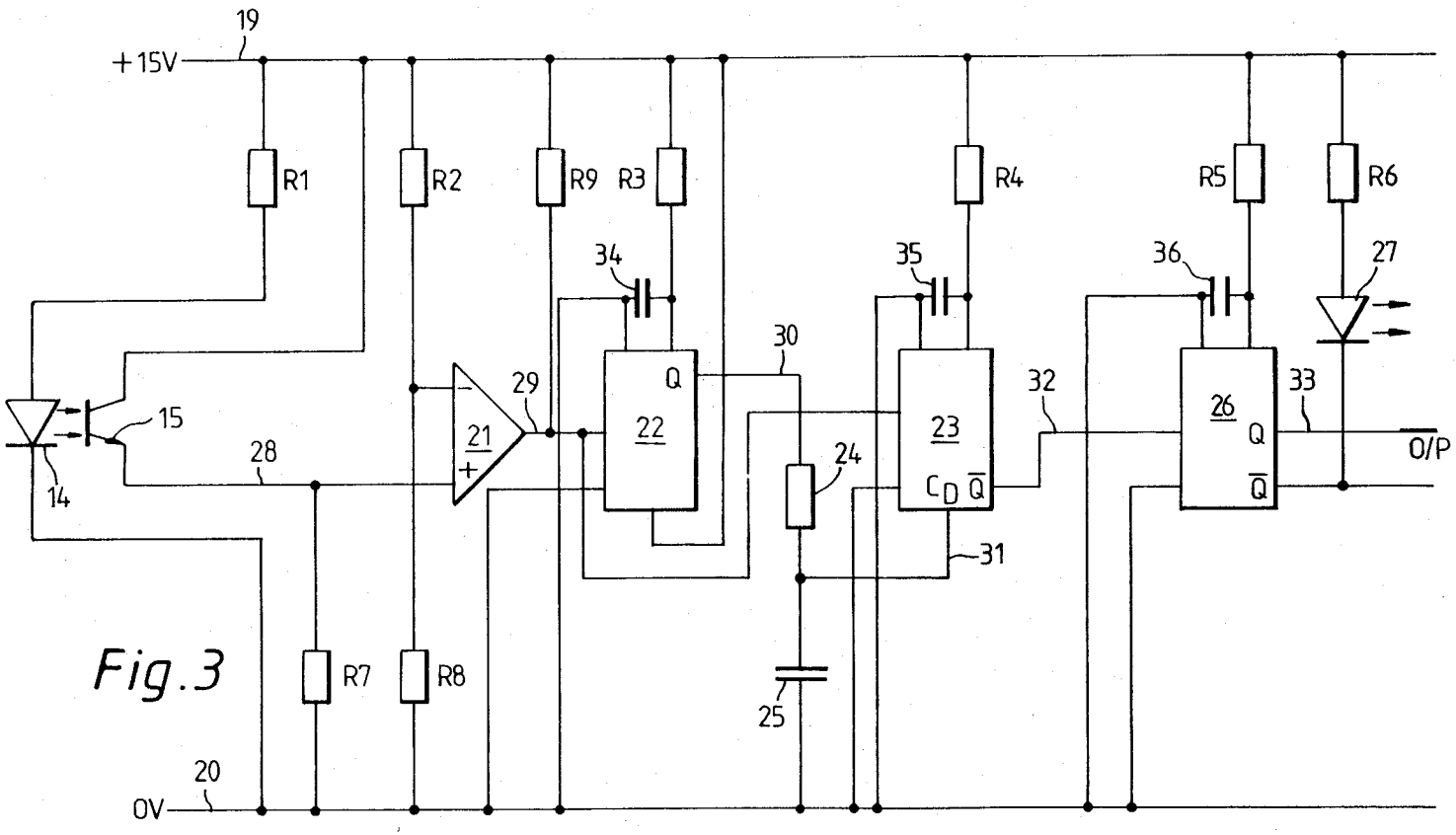
FIG. 3 is a block circuit diagram associated with the detecting means.

FIGS. 4*a* to 4*f* are timing diagrams of signals pertaining to the circuit of FIG. 3.

Figure 1:
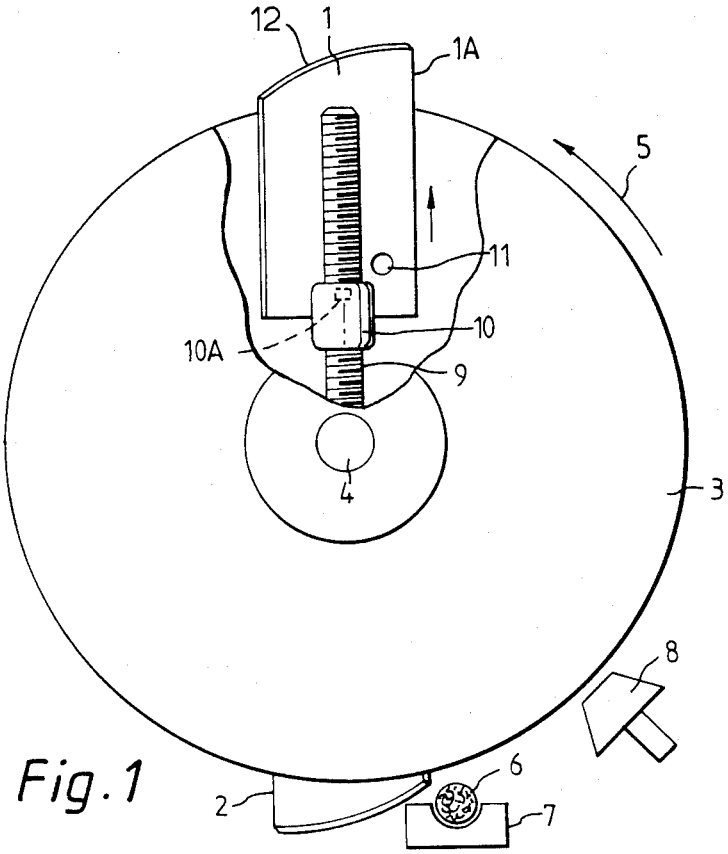
FIG. 1 is a partly cut away elevation of a rotary cut-off knife in the direction of the axis of rotation.

FIG. 1 shows two knives 1 and 2 mounted on a drum 3 which is rotated by a shaft 4 in the direction of the arrow 5. A cigarette rod 6 is axially transported in a direction perpendicular to the plane of the paper. As it passes the drum 3, it is supported in a ledger 7 and is cut by knives 1 and 2 alternately. After each knife has performed a cut on the cigarette rod 6, that knife is sharpened by a sharpener which is shown diagrammatically in the form of a grinding wheel 8.

The knife 1 is incrementally fed radially outwards during rotation of drum 3 on shaft 4 by means of a threaded shaft 9 which is screwed through a nut 10 formed with a lug 10A engaging in a corresponding drive aperture in the knife. This is shown in the cut away portion of FIG. 1. A similar arrangement exists for knife 2 but is not shown in FIG. 1.

A hole 11 is formed near the trailing edge 1A of each of the knives 1 and 2. FIG. 1 shows knife 1 in a partially worn condition wherein the hole 11 is well away from the cutting edge 12 of the knife.

Figure 2:
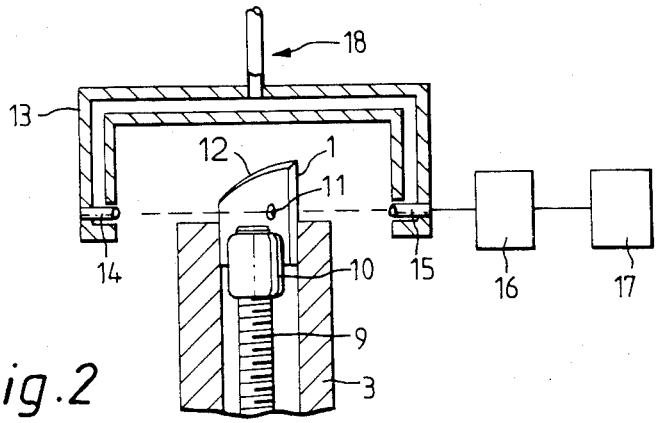
FIG. 2 is a sectional view from the right of FIG. 1, showing also the detecting means.

FIG. 2 shows the knife 1 in a fully worn condition so that the hole 11 is much closer to the cutting edge 12 and is clear of the drum 3.

The knives 1 and 2 are mounted obliquely on the drum 3 so that their cutting edges 12 form parts of a helix, the knives being held for that purpose by resilient clamps which locate the knives firmly with respect to the drum while allowing them to be fed slowly in a radially outward direction as the drum 3 rotates. This enables the knife, in a well known manner, to make transverse cuts through the rod; the axis of the shaft 4 for that purpose is inclined to the rod axis, though FIG. 1 has been simplified and does not that. The speed of rotation of the drum 3 and the degree of obliqueness of the knives and shaft are set so that the cutting edge 12 has a component of motion in the same direction and at the same speed as the cigarette rod 6.

FIG. 2 shows a framework 13 supporting a light emitter 14 and a light detector 15 on opposite sides of the knife 1. The light emitter and detector pair may be a "Skanimatic L33" system which works in the non-visible infra-red range. The light detector 15 is connected via logic circuitry 16 (which is described more fully with reference to FIG. 3), to a microprocessor 17. A source of compressed air 18 blows air from around light emitter 14 and detector 15 to prevent debris collecting on either of those parts.

FIG. 3 shows in block form the logic circuitry 16 of FIG. 2. Light emitter 14 is in the form of a light emitting semi-conductor device, such as an LED, and is supplied with power from the power rails 19 (+15 volts) and 20 (0 volts). Light from the emitter 14 impinges (if is free to do so) on light detector 15 which is in the form of a phototransistor and is supplied with power also from power rails 19 and 20. Light detector 15 is connected to one input of a comparator 21. The other input (inverting) of the comparator 21 is connected to the positive supply rail 19. The output of comparator 21 is connected to the triggering input of a first monostable 22 and also to the triggering input of a second monostable 23. The Q output of the first monostable 22 is connected via timing components consisting of resistor 24 and capacitor 25 to the $C_D$ input of the second monostable 23. This $C_D$ input is a disabling input preventing the monostable from triggering unless it is supplied with a positive voltage. The inverting output $\overline{Q}$ of the second monostable 23 is connected to the triggering input of a third monostable 26. The non-inverting Q output of the third monostable 26 is the output of logic circuit 16 (which indicates that the knife is spent) and is supplied to a microprocessor. A light emitting diode 27 is connected between the positive supply rail 19 and the inverting $\overline{Q}$ output of the third monostable 26. This light emitting diode lights when the outputs of the third monostable 26 indicate that the hole in the knife has been detected. The monostables 22, 23 and 26 may be taken from a single integrated circuit such as NC14538 manufactured by Motorola. Comparator 21 may be of the type MC3302P from the same manufacturers.

The operation of the arrangement illustrated in FIGS. 1, 2 and 3 will now be described with reference to FIGS. 4*a* to 4*f*.

Figures 4A, 4B, 4C, 4D, 4E, 4F:
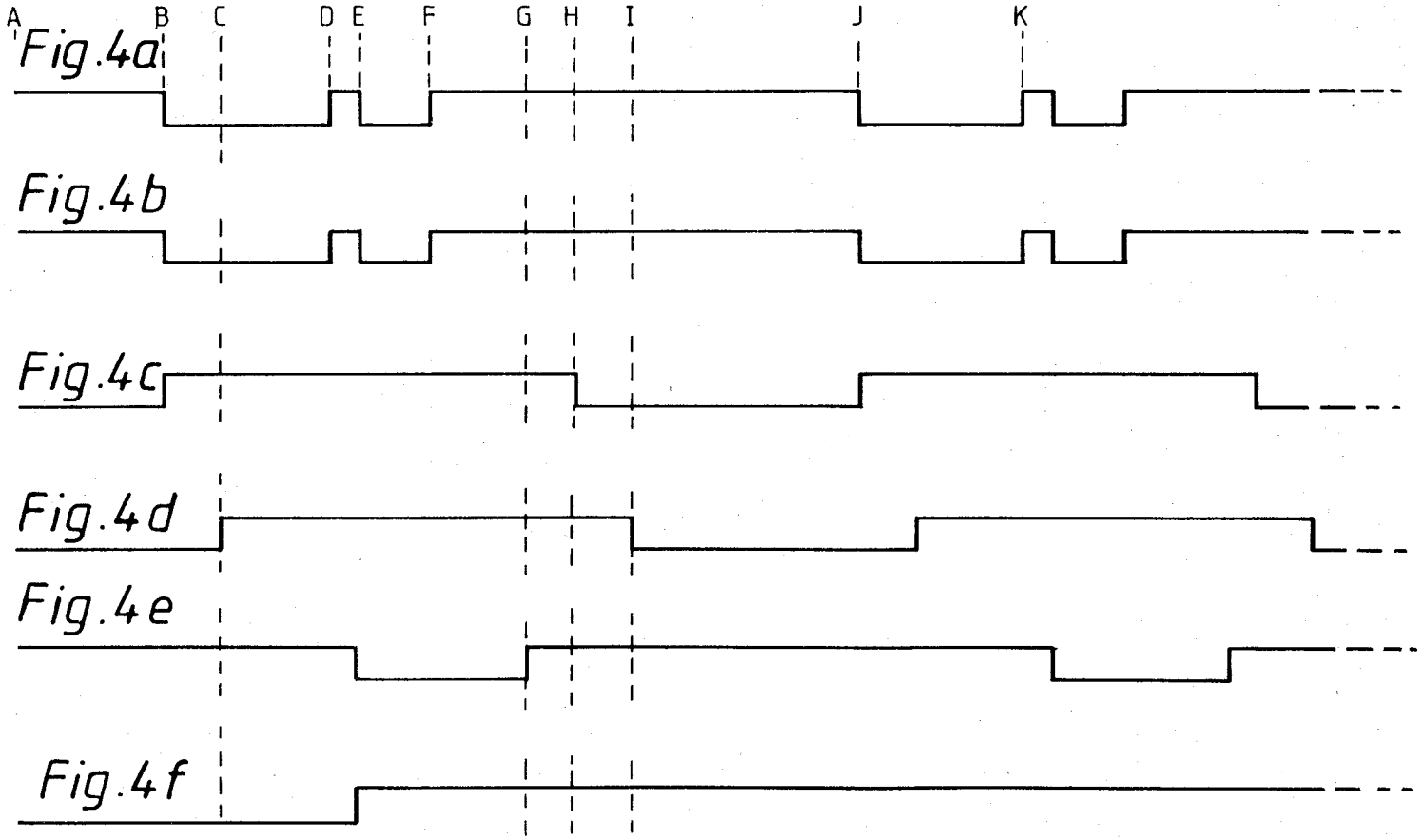

For the sake of clarity consider first a single knife on drum 3, e.g. knife 1. When the knife 1 is clear of framework 13 the infra-red beam between emitter 14 and detector 15 will be unbroken, so the phototransistor forming the detector 15 will conduct and provide a positive voltage on line 28 to the non-inverting input of comparator 21. The waveform supplied by detector 15 i.e. the signal on line 28 is illustrated in FIG. 4*a*. Between points A and B of FIG. 4*a* the knife is clear of framework 13 and the infra-red beam is unbroken so that a positive voltage is supplied to the non-inverting input of comparator 21. The output of the comparator 21, i.e. the signal on line 29, is illustrated in FIG. 4*b* which shows that this output follows the non-inverting input and is therefore also high between points A and B.

At point B the leading edge of knife 1 blocks the infra-red beam, preventing the phototransistor forming detector 15 from conducting. Hence the voltage on lines 28 and hence 29 is pulled down to that of supply rail 20; i.e. the signals on lines 28 and 29 go "low". The monostables 22, 23 and 26 are arranged to be triggered by falling edges, i.e. transitions from "high" to "low". Hence at point B monostable 22 is triggered such that a "high" signal appears at its Q output on line 30 as illustrated in FIG. 4*c*. Monostable 23 is not triggered at this point B because its $C_D$ input, i.e. its disabling input, is connected to the 0 volts supply rail 20. Capacitor 25 is charged by the "high" signal on line 30 and so after a time dependent upon the actual values of capacitor 25 and resistor 24, the "$C_D$" input of monostable 23 goes "high" enabling this second monostable 23 to be triggered by a subsequent falling edge on line 29. Resistor 24 may, for example, be 47KΩ and capacitor 25 may be 0.0022 μF. The signal on line 31 at the input $C_D$ of the second monostable 23 is illustrated in FIG. 4*d* where it will be seen that capacitor 25 becomes charged sufficiently at point C. It should be noted that the rising edge shown at C in FIG. 4*d* will not be so steep in practice.

As knife 1 advances on its rotational path through the infra-red beam, the infra-red beam will impinge on hole 11, specifically between points D and E in FIGS. 4*a*. Hence infra-red light reaches detector 15 between points D and E and the phototransistor conducts producing a pulse of length D to E on line 28 (see FIG. 4*a*) and line 29 (see FIG. 4*b*) in FIG. 3. The falling edge at E on line 29 will cause the second monostable 23 to trigger, producing a falling edge at the $\overline{Q}$ output of the second monostable 23 on line 32 as shown in FIG. 4*e*. *The first monostable 22 will be unaffected by pulse D to E as it has already been triggered and its output is high for the period B to H (see FIG. 4c)*. The falling edge at E on line 32 (FIG. 4*e*) causes the third monostable 26 to trigger such that its non-inverting Q output on line 33 goes "high" as shown in FIG. 4*f*. This causes the light emitting diode 27 to light at point E in FIG. 4.

At point F in FIG. 4 the trailing edge of knife 1 clears the infra-red beam, enabling the phototransistor forming detector 15 to conduct and producing a "high" on lines 28 and 29. At point G the second monostable 23 times out and at point H the first monstable 22 times out and allows the system to look for another similar sequence of events. When the knife comes round again (or a second knife comes round) at point J the circuitry performs in an identical manner except that the third monostable 26 which is set to have a long output pulse period still has a "high" output and is retriggerable so that it retriggers as shown as point K when the hole is again detected, and the output on line 33 (FIG. 4*f*) is a continuous "high" for as long as the hole is detected. This signal is fed to the microprocessor which periodically samples it and gives and end-of-knife indication if a number of successive samples indicate that this signal is high.

The timing periods of monostables 22, 23 and 26 are determined by the values of capacitances 34, 35 and 36 respectively, which may conveniently in this example be 0.047 μF, 0.1 μF and 1 μF respectively. It will be appreciated that values of resistances R1 to R8 should be chosen to suit the particular circuit components and required parameters in each case. By way of example these values could be: R1=180KΩ, R2=82KΩ, R3=100KΩ=R4, R5=47KΩ, R6=8.2KΩ, R7=33KΩ=R8, R9=100KΩ.

In the embodiment described with reference to the drawings the system "looks for" for a light-to-dark transition (i.e. the leading edge of the knife), defines a time window in response to such a transition, and "looks for" a second of the same sense (i.e. the leading edge of the hole) within the defined time window. This time window is longer than the time taken by the knife to pass the detector. As an alternative, the system could "look for" for a dark-to-light transistion (i.e. the leading edge of the hole) and then for a light-to-dark transition (i.e. the trailing edge of the hole) within a predetermined time period or window.

The knife feed may be basically as in the Molins MK 9 cigarette making machine, which is based on a pawl and ratchet mechanism whereby the knife is fed by small increments at regular intervals, as described in U.S. Pat. No. 3,169,431. Alternatively, other forms of knife feed may be used. For example, a plunger co-axial with the rotary member carrying the knife or knives may be arranged to push at regular intervals a bell crank to produce an oscillatory motion which is transmitted via a uni-directional clutch to a threaded shaft such as the shaft 9 in FIG. 1, or the equivalent employed in the MK 9 machine, which therefore rotates through small steps in a direction such as to feed the knife radially outwards.

We claim:

1. A cut-off device for a cigarette making machine comprising a rotary member arranged to carry at least one knife for cutting a cigarette rod during each revolution of the rotary member, means for sharpening the cutting edge of the knife and means for slowly feeding the knife radially outwards to compensate for the removal of material by the sharpening means, wherein the cut-off device is arranged to be used with a knife formed with an aperture which will appear outside the rotary member when the knife is ready to be replaced, and includes means for detecting the aperture, the detecting means comprising a light emitter mounted on one side of the path of the knife, a light detector mounted on the other side of the path of the knife so as to receive a beam of light from the light emitter when the beam is not being interrupted by the knife, timing means responsive to the light detector detecting a predetermined light-/dark transition, for defining a predetermined time interval, and means responsive for the duration of said time interval to a subsequent predetermined light/dark tranistion for providing an indication that the hole has been detected.

2. A cut-off device according to claim 1 in which each of the transitions which the detecting means is arranged to detect is a light-to-dark transition, and in which the said predetermined time interval ends after the trailing edge of the knife has passed the detecting means, but before the next arrival at the detecting means of the leading edge of the knife or of another knife.

3. A cut-off device according to claim 1 or claim 2 in which the beam of light is substantially parallel to the axis of rotation of the rotary member.

4. A cut-off device according to claim 1 or claim 2 in which the light emitter and/or the light detector is carried by a frame having a passage through which air is blown outwards from around the emitter and/or detector.

5. A cut-off device according to claim 1 including retriggerable timing means arranged to be actuated upon detection of an aperture in the knife for providing a substantially continuous warning signal.

* * * * *